US006099916A

United States Patent [19]

Spatafora et al.

[11] Patent Number: 6,099,916

[45] Date of Patent: Aug. 8, 2000

[54] METHOD FOR GUMMING SHEET MATERIAL

[75] Inventors: Mario Spatafora, Bologna; Marco Ghini, S. Lazzaro di Savena, both of Italy

[73] Assignee: G. D. Societa'Per Azioni, Bologna, Italy

[21] Appl. No.: 09/286,034

[22] Filed: Apr. 5, 1999

[30] Foreign Application Priority Data

Apr. 8, 1998 [IT] Italy ..... B098A0229

[51] Int. Cl.[7] ..... B05D 1/04

[52] U.S. Cl. ..... 427/472; 427/207.1; 427/600

[58] Field of Search ..... 427/472, 600, 427/207.1, 208.6, 466, 420, 434.3, 434.5, 601; 118/620, 621, 50.1, 624; 156/528

[56] References Cited

U.S. PATENT DOCUMENTS 4,353,942 10/1982 Carey .
5,340,616 8/1994 Amano et al. .
5,695,833 12/1997 Bok et al. ..... 427/600

FOREIGN PATENT DOCUMENTS 1406167 11/1965 France .
2344342 10/1977 France .
3429335 2/1986 Germany .

OTHER PUBLICATIONS

English Abstract of FR 2344342 Dated Oct. 14, 1977.

English Abstract of DE 3429335 Dated Feb. 13, 1986.

*Primary Examiner*—Fred J. Parker
*Attorney, Agent, or Firm*—Ladas & Parry

[57] ABSTRACT

A method for gumming sheet material, whereby a sheet is fed along a path directly facing a free surface of a bath of gum, and an electric field is generated over a portion of the sheet to draw the gum onto the portion.

9 Claims, 2 Drawing Sheets

METHOD FOR GUMMING SHEET MATERIAL

FIELD OF THE INVENTION

The present invention relates to a method of gumming sheet material.

BACKGROUND OF THE INVENTION

Known units for gumming sheet material normally comprise mechanical gumming devices, in particular roller or spray devices, which involve several drawbacks.

In particular, roller gumming devices operate at relatively slow speed, by now well below the demands of modern machinery and in particular modern packing machines. Moreover, featuring a gumming roller rotating and partly immersed in a bath of gum, roller gumming devices are particularly "dirty" and require frequent cleaning. Finally, during machine stoppages, the bath of gum tends to dry by being left unstirred in contact with the air.

Spray gumming devices, on the other hand, are fairly expensive and unreliable due to frequent clocking of the spray nozzles.

FR-A1-981849 discloses a unit for gumming sheet material, wherein a roller advances the sheet material in contact with the surface of a bath of gum and an electric field is generated between the roller and the bath of gum to increase the portion of the sheet in contact with the glue. The aforementioned unit has several drawbacks; in particular, no possibility exists to gum, with such a unit, selected portions of the sheet material owing to the fact that, in such a unit, the sheet material is advanced in contact with the surface of the bath of gum. Furthermore, other portions of the sheet material, which have not to be gummed, may be soiled by the gum.

SUMMARY OF THE INVENTION

It is an object of the present invention to provide a method of gumming sheet material, designed to eliminate the aforementioned drawbacks, and which in particular is cheap and easy to implement while at the same time providing for rapid, accurate gumming.

According to the present invention, there is provided a method of gumming sheet material, the method of gumming sheet material, the method comprising the steps of feeding said sheet material along a path directly facing a free surface of a bath of gum; and generating an electric field over at least one portion of said sheet material to draw the gum onto said portion; characterized in further comprising the step of generating in said bath of gum at least one static wave facing said portion of said sheet material; said electric field being generated at said static wave.

The present invention also relates to a unit for gumming sheet material.

According to the present invention, there is provided a unit for gumming sheet material, the unit comprising a container for a bath of gum having a free surface; a conveyor for feeding said sheet material along a path directly facing said free surface of gum; and generating means for generating an electric field over at least one portion of said sheet material to draw the gum onto said portion; characterized in comprising exciting means for generating in said bath of gum at least one static wave facing said portion of said sheet material; said generating means facing said exciting means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
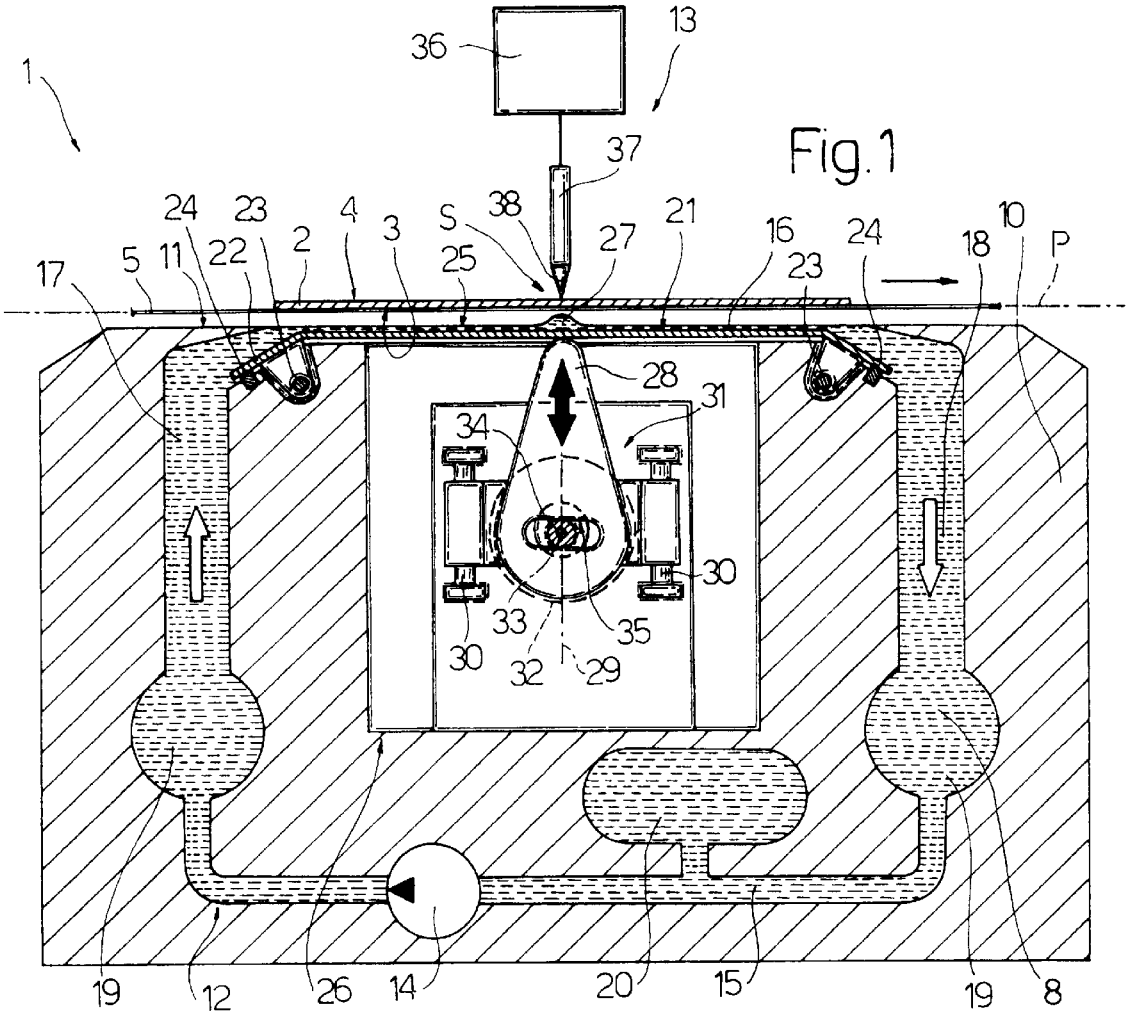
FIG. 1 shows a schematic, partially sectioned side view of a preferred embodiment of the unit according to the present invention.

Numeral 1 in FIG. 1 indicates as a whole a unit for gumming a sheet 2, which comprises a bottom surface 3 and a top surface 4 parallel to and opposite each other, and is fed by a known conveyor 5 (shown schematically) along a path P parallel to surfaces 3 and 4.

Figure 2:
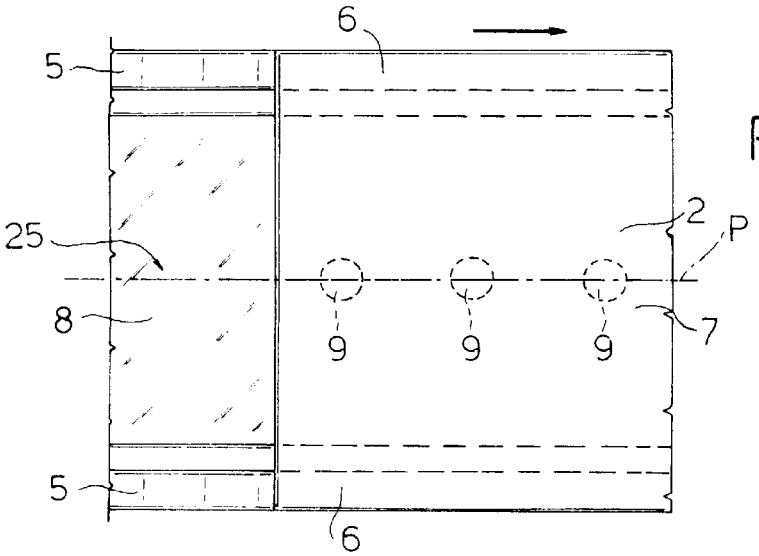
FIG. 2 shows a plan view, with parts removed for clarity, of a detail in FIG. 1.

As shown more clearly in FIG. 2, conveyor 5 engages sheet 2 at lateral ends 6 of sheet 2, leaving a central portion 7 of sheet 2 substantially free. In actual use, gumming unit 1 deposits liquid gum 8 on at least one portion 9 of surface 3, which portion 9 forms parts of central portion 7.

In addition to conveyor 5, gumming unit 1 also comprises a supporting body 10 located beneath conveyor 5 and having a surface 11 parallel to and facing bottom surface 3 of sheet 2; a circuit 12 for circulating gum 8 and formed in body 10; and a generating device 13 for generating an electric field over portion 9.

Circuit 12 is an endless circuit along which gum 8 is fed (clockwise in FIG. 1) by a pump 14 housed in a bottom conduit 15 of circuit 12; circuit 12 also comprises an open-topped channel 16 extending parallel to path P and for receiving gum 8 from a delivery conduit 17 and supplying it to a return conduit 18; conduits 17 and 18 are connected to conduit 15 by respective expansions 19; and a refill tank 20 is provided along conduit 15 to keep circuit 12 filled with gum 8 at all times.

Channel 16 is formed in surface 11 of supporting body 10, and is defined at the bottom by a bottom wall 21 in turn defined by a metal plate 22, the free ends of which are fitted to body 10 by a pair of hinges 23. Two fluidtight sealing elements 24 made of elastic material are provided at hinges 23 to prevent infiltration of gum 8 from conduits 17 and 18; and gum 8 flows along channel 16 with a free surface 25 substantially parallel to and facing surface 3.

Unit 1 also comprises an exciting device 26 located beneath plate 22 and for vibrating plate 22 at a given resonance frequency to generate a static wave 27 in gum 8 in channel 16.

Exciting device 26 comprises a mechanical member 28 fitted to two lateral guides 30 so as to slide in a direction 29 perpendicular to wall 21, and which is vibrated at said resonance frequency by an actuator 31 comprising an eccentric cam 32, which rotates about an axis 33 perpendicular to the FIG. 1 plane, and is connected to mechanical member 28 by a pin 34 engaging a seat 35 formed in member 28 and perpendicular to direction 29.

Generating device 13 comprises a control member 36 for separating electric charges in time with the movement of conveyor 5; and a body 37 of conducting material, which is connected electrically to control member 36, and comprises a tip 38 located over top surface 4 of sheet 2 at static wave 27 in gum 8, so as to define a gumming station S between tip 38 and wave 27.

Figure 3:
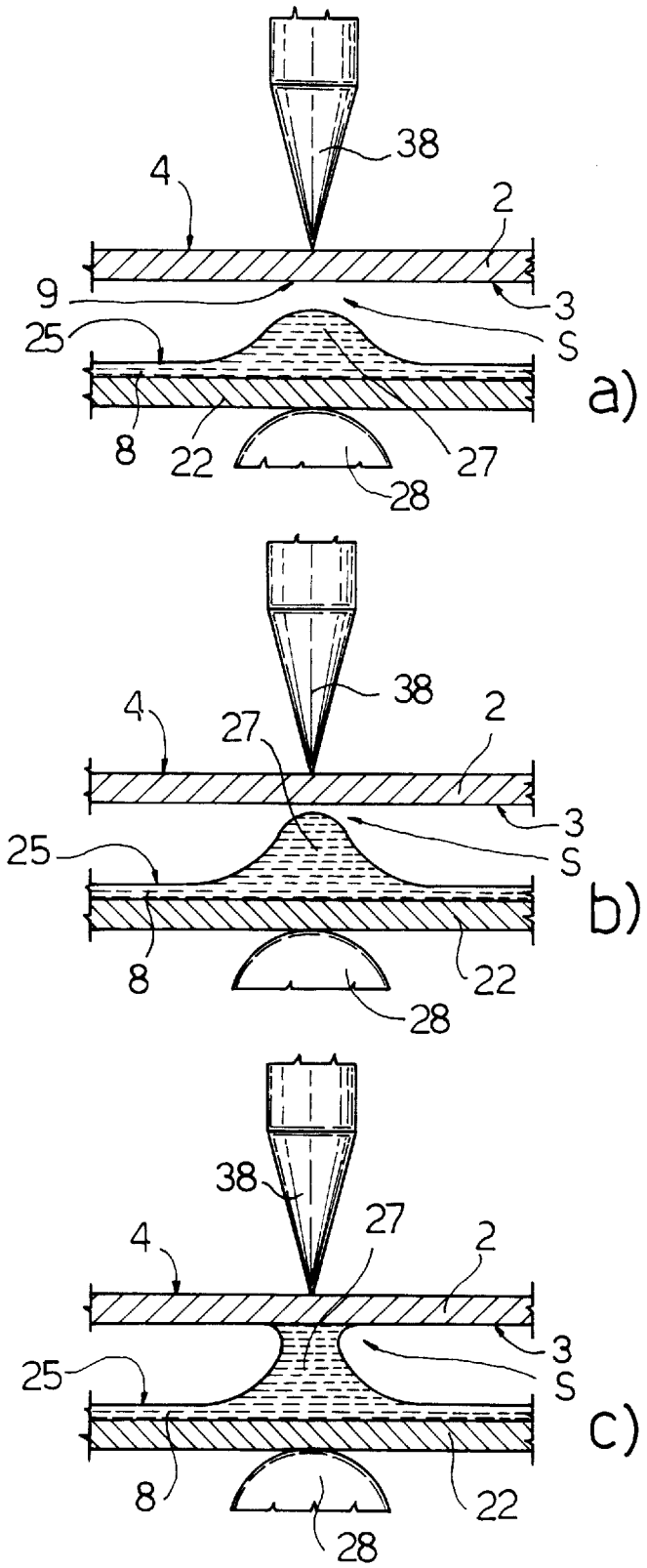
FIG. 3 shows a larger-scale detail of FIG. 1 in three different operating positions.

Operation of gumming unit 1 will be described with reference to FIG. 3, and as of the instant in which a sheet 2 is fed by conveyor 5 along path P.

In actual use, exciting device 26 is maintained permanently active to vibrate plate 22 at a given resonance frequency as described above, and so generate static wave 27 in gum 8 in channel 16 (FIG. 3*a*).

As portion 9 of sheet 2 to be gummed is fed by conveyor 5 through gumming station S, generating device 13 generates an electric field over portion 9 to draw static wave 27 in gum 8 onto portion 9 (FIG. 3*b*), and so gum portion 9 with gum 8 (FIG. 3*c*).

Once portion 9 is gummed, the electric field is eliminated, and gum 8 is restored to its original position (FIG. 3*a*).

The electric field is generated by generating device 13 by means of control member 36, which separates the charges to concentrate most of the positive or negative charges in tip 38.

As shown in FIG. 2, sheet 2 may comprise several successive gumming portions 9 aligned in the traveling direction of sheet 2 along path P. In which case, generating device 13 generates an electric field for each portion 9 fed through gumming station S.

In an alternative embodiment not shown, generating device 13 comprises a number of bodies 37 for gumming portions 9 located crosswise to the traveling direction of sheet 2 along path P. The various bodies 37 may be activated together or singly to gum sheet 2 with portions 9 arranged in a predetermined pattern.

In a further embodiment not shown, gumming unit 1 comprises at least one body 37 movable crosswise to the traveling direction of sheet 2 along path P, so as to vary, with respect to sheet 2, the location in which the electric field is generated.

In yet a further embodiment not shown, unit 1 has no exciting device 26, so that, in use, no static wave is generated in gum 8 in channel 16, and the gum is brought into contact with portion 9 at gumming station S solely by the electric field generated by generating device 13.

It should be pointed out that unit 1 is both cheap and easy to produce, and provides for achieving relatively high operating speeds. Moreover, during machine stoppages, gum 8 may be kept moving along circuit 12 and so prevented from drying.

What is claimed is:

1. A method of gumming at least a portion of a sheet material, the method comprising the steps of feeding said sheet material (2) along a path (P) directly facing a surface (25) of a bath of gum (8), generating an electric field over at least one portion (9) of said sheet material (2) to draw the gum (8) from said bath onto said portion (9), generating in said bath of gum (8) at least one static wave (27) facing said portion (9) of said sheet material (2), said electric field being generated in correspondence with said static wave (27), wherein said electric field is generated, at successive instants in the travel of said sheet material (2), at various portions (9) of said sheet material (2) arranged in a predetermined gumming pattern.

2. A method as claimed in claim 1, wherein said path (P) is substantially parallel to said surface (25) of said bath of gum (8).

3. A method as claimed in claim 1, wherein said bath of gum (8) is formed by circulating said gum (8) along an open-topped channel (16) extending parallel to said path (P).

4. A method as claimed in claim 3, wherein said static wave (27) is generated by vibrating a bottom wall (21) of said channel (16) at a given resonance frequency.

5. A method as claimed in claim 4, wherein said bottom wall (21) is vibrated by exciting the bottom wall (21) by means of a mechanical member (28), which is vibrated at said given resonance frequency and in a direction (29) perpendicular to said bottom wall (21).

6. A method of gumming at least a portion of a sheet material, the method comprising the steps of feeding said sheet material (2) along a path (P) directly facing a surface (25) of a bath of gum (8), generating an electric field over at least one portion (9) of said sheet material (2) to draw the gum (8) from said bath onto said portion (9), generating in said bath of gum (8) at least one static wave (27) facing said portion (9) of said sheet material (2), said electric field being generated in correspondence with said static wave (27), wherein said bath of gum (8) is formed by circulating said gum (8) along an open-topped channel (16) extending parallel to said path (P), and said static wave (27) is generated by vibrating a bottom wall (21) of said channel (16) at a given resonance frequency.

7. A method as claimed in claim 6, wherein said path (P) is substantially parallel to said surface (25) of said bath of gum (8).

8. A method as claimed in claim 6, wherein said bottom wall (21) is vibrated by exciting the bottom wall (21) by a mechanical member (28), which is vibrated at said given resonance frequency and in a direction (29) perpendicular to said bottom wall (21).

9. A method as claimed in claim 6, wherein said electric field is generated, at successive instants in the travel of said sheet material (2), at various portions (9) of said sheet material (2) arranged in a predetermined gumming pattern.

* * * * *

UNITED STATES PATENT AND TRADEMARK OFFICE

CERTIFICATE OF CORRECTION

PATENT NO.: 6,099,916

DATED: August 8, 2000

INVENTOR(S): Mario SPATAFORA, et al.

It is certified that error appears in the above-identified patent and that said Letters Patent are hereby corrected as shown below:

On title page, item 73, "D." should read - - D - - .

Signed and Sealed this

First Day of May, 2001

Nicholas P. Godici

*Attest:*

NICHOLAS P. GODICI

*Attesting Officer*

*Acting Director of the United States Patent and Trademark Office*